US007926215B2

(12) United States Patent
Riker et al.

(10) Patent No.: US 7,926,215 B2
(45) Date of Patent: Apr. 19, 2011

(54) HOME SHOWING LOCKBOX TAG SYSTEM

(75) Inventors: Terri L. Riker, Tustin, CA (US); Cheryl M. Olivere, Tustin, CA (US)

(73) Assignee: Realtor Biz Resources, Inc., Palm Desert, CA (US)

( * ) Notice: Subject to any disclaimer, the term of this patent is extended or adjusted under 35 U.S.C. 154(b) by 0 days.

(21) Appl. No.: 12/188,717

(22) Filed: Aug. 8, 2008

(65) Prior Publication Data

US 2009/0038195 A1 Feb. 12, 2009

Related U.S. Application Data

(60) Provisional application No. 60/954,786, filed on Aug. 8, 2007, provisional application No. 60/990,878, filed on Nov. 28, 2007.

(51) Int. Cl.
*G09F 3/00* (2006.01)

(52) U.S. Cl. ..... 40/654.01; 70/55; 70/56; D8/346

(58) Field of Classification Search ..... 40/124.06, 40/330, 331, 359, 6, 633, 637, 639, 661.08; D8/330–348
See application file for complete search history.

(56) References Cited

U.S. PATENT DOCUMENTS

| | | | | |
|---|---|---|---|---|
| 1,244,404 | A | 10/1917 | Ankovitz | |
| 1,662,612 | A | 12/1924 | Junkunc | |
| 1,528,720 | A * | 3/1925 | Wittstein | 40/639 |
| 1,581,953 | A * | 4/1926 | Jackson | 70/55 |
| 2,828,157 | A | 1/1956 | Fox et al. | |
| 3,559,429 | A | 1/1969 | Hermann | |
| 3,858,419 | A | 1/1975 | Hampton | |
| 4,134,280 | A | 1/1979 | Pelavin | |
| 4,297,861 | A | 11/1981 | Dykes | |
| 4,317,344 | A | 3/1982 | Barnard | |
| 4,534,190 | A * | 8/1985 | Stanich | 70/54 |
| 4,576,022 | A | 3/1986 | Gamble | |
| 4,651,543 | A | 3/1987 | Heald et al. | |
| D292,869 | S | 11/1987 | Lebrecht | |
| 4,865,352 | A * | 9/1989 | Gollon | 283/79 |
| 4,897,945 | A * | 2/1990 | Webb | 40/331 |
| 4,926,662 | A | 5/1990 | Gaudet | |
| 5,003,795 | A | 4/1991 | Hoke | |
| 5,046,339 | A | 9/1991 | Krell | |
| 5,218,846 | A | 6/1993 | Cook et al. | |
| 5,236,527 | A | 8/1993 | Brodsky | |
| 5,275,028 | A | 1/1994 | Giarrante | |
| 5,426,959 | A | 6/1995 | Kies | |
| 5,477,710 | A | 12/1995 | Stefanutti | |
| 5,544,505 | A | 8/1996 | McIntosh et al. | |
| 5,615,567 | A | 4/1997 | Kemp | |
| 5,638,707 | A | 6/1997 | Gould | |
| 5,775,149 | A | 7/1998 | Small | |
| 5,875,659 | A | 3/1999 | Nosse | |
| D408,265 | S | 4/1999 | Bills | |

(Continued)

*Primary Examiner* — Joanne Silbermann
*Assistant Examiner* — Shin Kim
(74) *Attorney, Agent, or Firm* — Myers Andras Sherman & Zarrabian LLP; Joseph C. Andras

(57) ABSTRACT

A plurality of color-coded lockbox tags that attach to a lockbox and visibly communicate a corresponding plurality of showing instructions relative to the lockbox. Where the underlying lockbox includes an entry mechanism involving an infrared port, the lockbox tag may include an aperture or window to expose an infrared port. A plurality of optional placards may also be provided to augment or override the primary showing instructions of the lockbox tag.

11 Claims, 12 Drawing Sheets

U.S. PATENT DOCUMENTS

| | | | | | |
|---|---|---|---|---|---|
| 5,924,314 | A | | 7/1999 | Cernansky | |
| 6,006,899 | A | * | 12/1999 | McAuley et al. | 206/6.1 |
| 6,058,639 | A | * | 5/2000 | Tinklenberg et al. | 40/665 |
| D436,016 | S | * | 1/2001 | Gould | D8/346 |
| 6,192,721 | B1 | | 2/2001 | Monteleone | |
| D442,059 | S | | 5/2001 | Turner | |
| 6,330,816 | B1 | | 12/2001 | O'Connor | |
| D470,745 | S | | 2/2003 | Gast | |
| D470,746 | S | | 2/2003 | Gast | |
| 6,526,786 | B1 | * | 3/2003 | Kayoda | 70/56 |
| D499,328 | S | * | 12/2004 | Spoon | D8/346 |
| D569,226 | S | * | 5/2008 | Brewster et al. | D8/346 |

* cited by examiner

HOME SHOWING LOCKBOX TAG SYSTEM

PRIORITY CLAIM

This patent application claims the benefit under 35 USC 119 of the priority date of U.S. Provisional Patent Application Ser. No. 60/954,786, filed on Aug. 8, 2007, entitled HOME SHOWING LOCK BOX TAG SYSTEM and of the priority date of U.S. Provisional Patent Application Ser. No. 60/990,878, filed on Nov. 28, 2007, entitled HOME SHOWING LOCKBOX TAG SYSTEM. The entire contents of these provisional patent applications are hereby incorporated by reference.

FIELD OF THE INVENTION

The present invention relates generally to home sales apparatus and, more particularly, to a home showing lockbox tag system.

BACKGROUND OF THE INVENTION

When a home owner puts his or her residential property on the market for sale, the listing agent need to determine accessibility to licensed real estate agents based on the instructions from the Seller. This includes whether or not to use a lockbox, and if so, the location and the type of access (e.g. go direct, call first, appointment only or a combination of these). Information about the property, including access and instructions to show the home, are mutually agreed upon by the listing agent and the owner. This information, as well as detailed information about the property is often entered into a Multiple Listing System (MLS) by the listing agent, assistant or authorized MLS user.

Typical data input categories (related to showing instructions) include: Showing Instructions, Type of Key Safe, Key Safe Location, Signage and Agent Remarks. Each MLS system varies with regard to data fields, but this data requires updating as conditions change regarding property occupancy, days/hours available for showing, and special instruction to showing agents.

Signage is controlled by the city, subdivision or community and in many cases, flyer boxes are not permitted and in exclusive communities "For Sale" signs are also prohibited.

A lockbox (aka key safe or key box) is a box that stores a key. A lockbox typically includes a main body with an internal key box, and a hanging shackle defining a shackle passage that may be opened for releasably securing the lockbox to a fixed hanging point.

A lockbox is a standard and accepted device for residential home sales. In the real estate sales field, the listing agent routinely hangs a lockbox on or near a listed property so that multiple showing agents can conveniently access the property without assistance. The lockbox is generally permitted on doors, gates, water pipes or gas meters.

Lockboxes come in two general forms; electronic lockboxes and mechanical lockboxes. Electronic lockboxes are predominant in the real estate sales field because they include security features (e.g. audit trails showing who opened them and when, disablement of lost or stolen "keys", etc.) and convenience features (e.g. time of day lockout that help control access in conformance with an owner or tenant's wishes). Mechanical lockboxes that require a special key, combination, or both are available, but they generally lack the enhanced security and convenience features so they are less common in the real estate sales field.

FIG. 1 shows a residential home 100 that has been offered "for sale" and has been fitted with a lockbox 110 having a key secured therein. Here, the lockbox 110 is attached or shackled to the door knob 102 of the property's front door 101 so that the listing agent and many showing agents can retrieve the key and enter the home.

In general, lockboxes used by real estate agents are issued and assigned only to licensed real estate agents who belong to a local association or MLS Board. Each lockbox has a unique serial number and standard preprogrammed features.

FIGS. 2A, 2B, 3A, and 3B illustrate four typical lockboxes 110, 120, 130, 140 that are frequently used by real estate agents; two that are sold by General Electric ("GE") (items 110 and 120) and two that are sold by SentriLock (items 130 and 140). As noted above, there are also generic combination-type and key-type lockboxes but they are generally sold for use by non-agents.

When a property is listed for sale, all of the information regarding the property is generally contained within the MLS system under that property listing. The lockbox itself usually has no information on the exterior of the device and it provides no immediate visual instructions regarding access to, or features of the home. The listing agent can put written information in the Lockbox's key box along with the key so that certain information is passed along to the showing agent when the key box is opened (e.g. an alarm code or instructions regarding a pet). However, that information is not visible from a distance and is only available after the lockbox is opened.

It is possible to program "time of day" limitations on access to the lockbox (i.e. hours of operation) through the local Realtor® Association or MLS Board. This is a useful feature, but is somewhat inflexible. A listing agent is the only one authorized to request a change and must physically bring the lockbox to the local Realtor®'s office to have the hours changed. The listing agent assigns a password to each lockbox and must also provide that to the Association. This process is cumbersome to an agent who is marketing a property with frequently changes in access hours or showing instructions.

In addition, the owner, tenant, or guest of the home have no control over showing agents who arrive at the home unprepared or with outdated information.

There remains a need, therefore, for a lockbox tag system that overcomes the shortcomings of the present lockboxes and related MLS information.

BRIEF SUMMARY OF THE INVENTION

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112.

The present invention specifically addresses and alleviates the above mentioned deficiencies associated with the prior art.

In one aspect, the present invention comprises a lockbox tag system for use with a lockbox having a main body with an internal key box for storing a key, a front side that carries an access mechanism for opening the key box, a back side, and a hanging shackle defining a shackle passage for securing the main body to a fixed hanging point, the lockbox tag system comprising a plurality of color-coded lockbox tags that attach to the lockbox and visibly communicate a corresponding plurality of desired accessibility states or showing instructions relative to the lockbox.

In another aspect, the present invention comprises a lockbox tag system for use with a lockbox having a main body with an internal key box for storing a key, a front side that carries an access mechanism for opening the key box, a back side, and a hanging shackle defining a shackle passage for securing the main body to a fixed hanging point, the lockbox tag system comprising: three color-coded "I"-shaped lockbox tags that visibly communicate three desired accessibility states or showing instructions relative to the lockbox; each "I"-shaped lockbox tags comprising a front panel that is substantially flat and sized to cover at least a portion of the lockbox's main body's front side, and a back panel that is substantially flat and sized to cover at least a portion of the lock box's main body's back side, and a narrow middle portion that is sized to fit within the shackle passage, the middle portion flexibly connecting the front and back panels to one another with the front and back panels in a substantially vertical orientation adjacent to the front and back sides, respectively, of the lockbox; and the three color-coded "I"-shaped lockbox tags formed from a flexible material, the back panel foldable between a flat state and a folded state and sized to pass through the shackle passage when in the folded state.

These and other advantages of the present invention will be more apparent from the following description and drawings. It is understood that changes in the specific structures shown and described may be made within the scope of the claims, without departing from the spirit of the invention.

BRIEF DESCRIPTION OF THE DRAWINGS

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
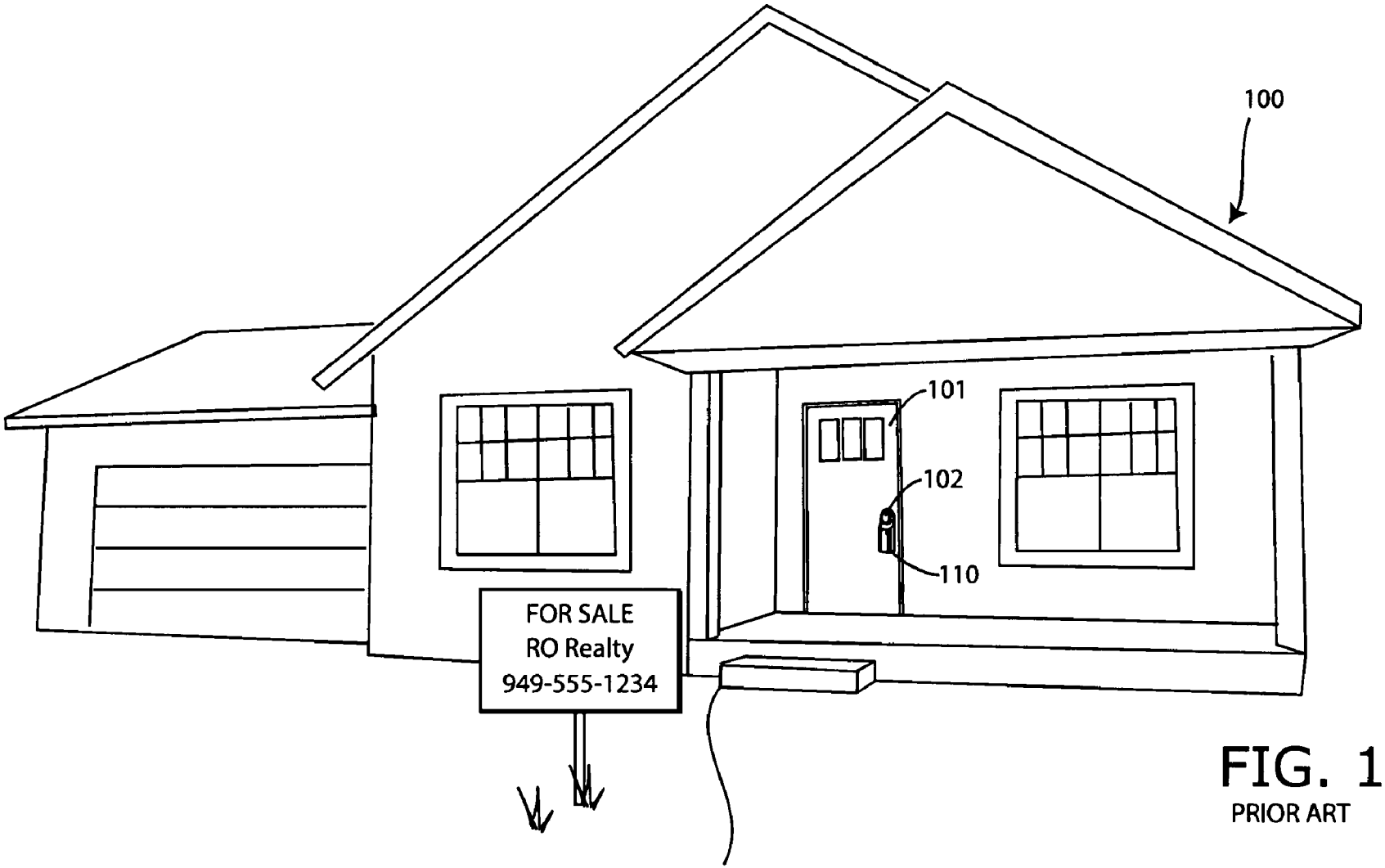
FIG. 1 PRIOR ART
FIG. 1 shows a residential home 100 that is offered "for sale" and has a lockbox 110 with a key secured therein attached to the door knob 102 of its front door 101 so that the listing agent and many showing agents can retrieve the key and enter the home at suitable times.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Thus, the detailed description set forth below in connection with the appended drawings is intended as a description of the presently preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions may be accomplished by different embodiments that are also intended to be encompassed within the spirit of the invention.

Thus, these and other modifications and additions may be obvious to those skilled in the art and may be implemented to adapt the present invention for use in a variety of different applications.

FIG. 1 depicts a lockbox 110 secured to a home 100 that is for sale. FIGS. 2A, 2B, 3A and 3B are four examples of electronic lockboxes that are commonly used by real estate agents, including a GE Supra iBox™ 110 (the box shown in FIG. 1), a GE RISCO™ lockbox 120, a SentriLock™ lockbox 130, and the newer SentriLock™ Realtor® Lockbox NXT™ 140. Each lockbox includes a main body 112, 122, 132, 142 and a hanging shackle 113, 123, 133, 143 that defines a shackle passage 114, 124, 134, 144. As also shown by these four examples, lockboxes may have different sizes, different geometries, and different opening mechanisms. The GE Supra iBox™ 110 of FIG. 2A, for example, includes an infrared port 111 located in the upper right corner of its main body 112. The GE RISCO™ lockbox 120 of FIG. 2B also includes an infrared port 121, but instead of being located toward one side, it is centrally located in the upper half of its main body 122. The SentriLock™ 130 of FIG. 3A does not use a remote port of any kind, and instead includes a keypad 131. Finally, the SentriLock™ Realtor® Lockbox NXT™ 140 of FIG. 3B uses a keypad 141 and also a "smart card" slot 146 at its bottom.

Figure 4:
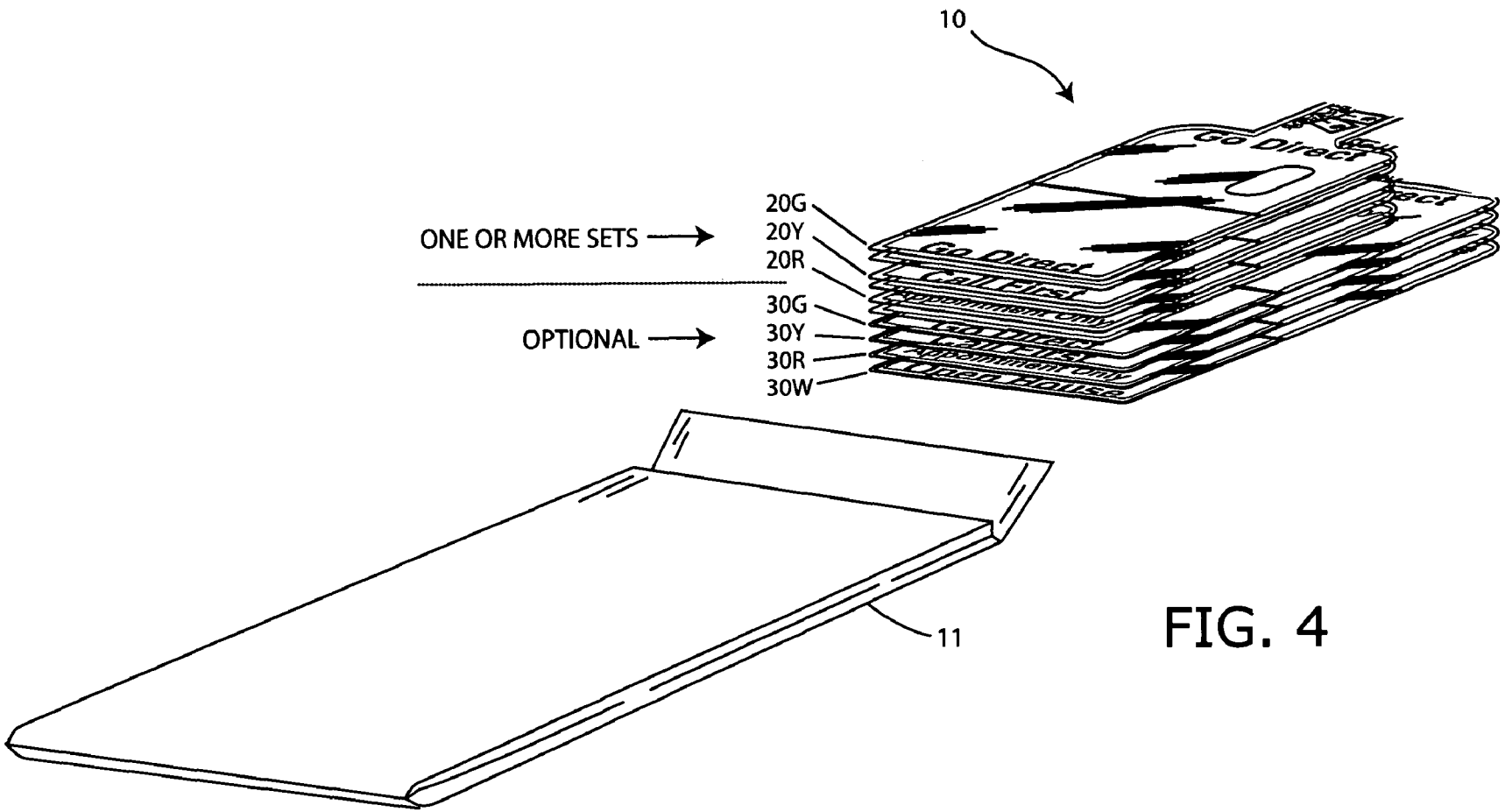
FIG. 4 shows a presently preferred lockbox tag system 10 that is sold in a clear and compact storage envelope 11 for use by a real estate agent and/or the home owner. As shown, the preferred lockbox tag system 10 comprises a plurality of lockbox tags 20 that are provided in information relaying colors and optionally with corresponding indicia and, as a further option, also comprises a cooperating plurality of placards 30 that augment the plurality of lockbox tags 20 that are also provided in information relaying colors and optionally with corresponding indicia. The preferred system 10 includes one or more sets of three lockbox tags 20G, 20Y, 20R of a first preferred construction. The preferred tags number three and are provided in the colors of green, yellow and red because they mnemonically suggest "go," "caution," and "stop." The preferred tags also bear suitable indicia such as "go direct," "call first," and "appointment only." The preferred system 10 may further include or be used with four supplemental placards 30G, 30Y, 30R, 30W that are green, yellow, red, and white, and that have the corresponding indicia of "go direct," "call first," "appointment only" and, in the case of the white placard, "open house."

FIG. 4 depicts a presently preferred lockbox tag system 10 that is contained in a compact envelope 11 and formed from a coordinated plurality of color coded lockbox tags 20 and an optional plurality of placards 30 that are designed to be applied "to", "in" or "around", and used in conjunction with, a real estate lockbox like those discussed above.

Figure 2B:
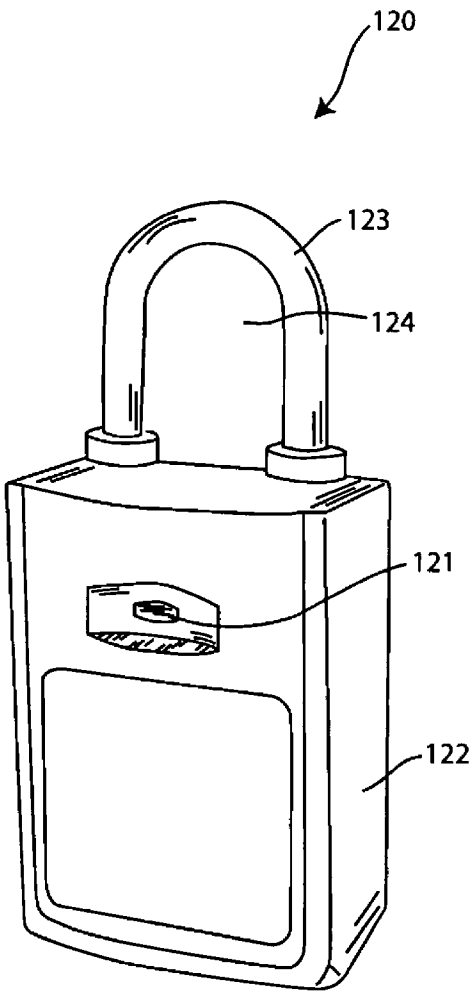
FIG. 2B PRIOR ART
FIG. 2B shows a second exemplary and commonly used lockbox that may be enhanced with suitable embodiments of a lockbox tag system according to the present invention, namely a GE RISCO™ lockbox 120 that includes a centrally-located IrDA infrared lens or port 121 for opening the lockbox and accessing the key stored therein using a suitable "point and beam" device such as a "DisplayKey" device, an "ActiveKEY" device, or a PDA running "eKey" software.
Figure 2A:
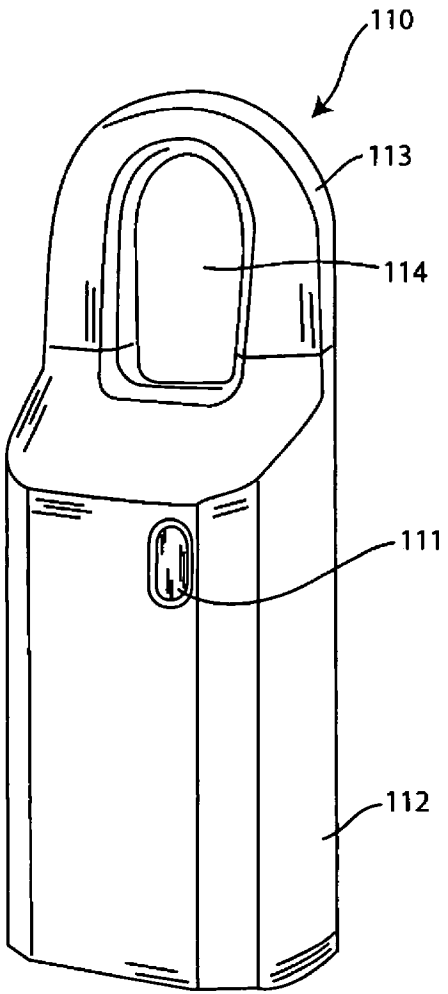
FIG. 2A PRIOR ART
FIG. 2A shows a first exemplary and commonly used lockbox that may be enhanced with suitable embodiments of a lockbox tag system according to the present invention, namely a GE Supra iBox™ 110 that includes an offset IrDA infrared lens or port 111 for opening the lockbox and accessing the key stored therein using a suitable "point and beam" device such as a "DisplayKey" device, an "ActiveKEY" device, or a PDA running "eKey" software.
Figure 3B:
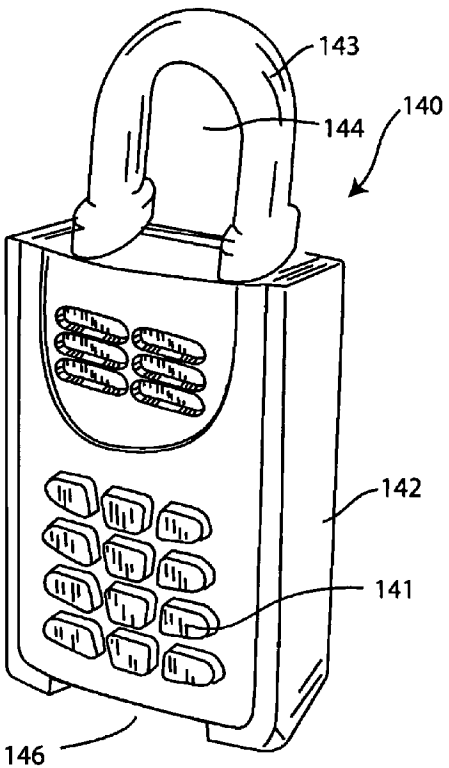
FIG. 3B PRIOR ART
FIG. 3B shows a fourth exemplary and more recently introduced lockbox that may be enhanced with suitable embodiments of a lockbox tag system according to the present invention, namely a SentriLock™ Realtor® Lockbox NXT™ 140 that includes a keypad 141 and a card slot 146 for accessing the key stored therein using a key code or a smart card (not shown)
Figure 3A:
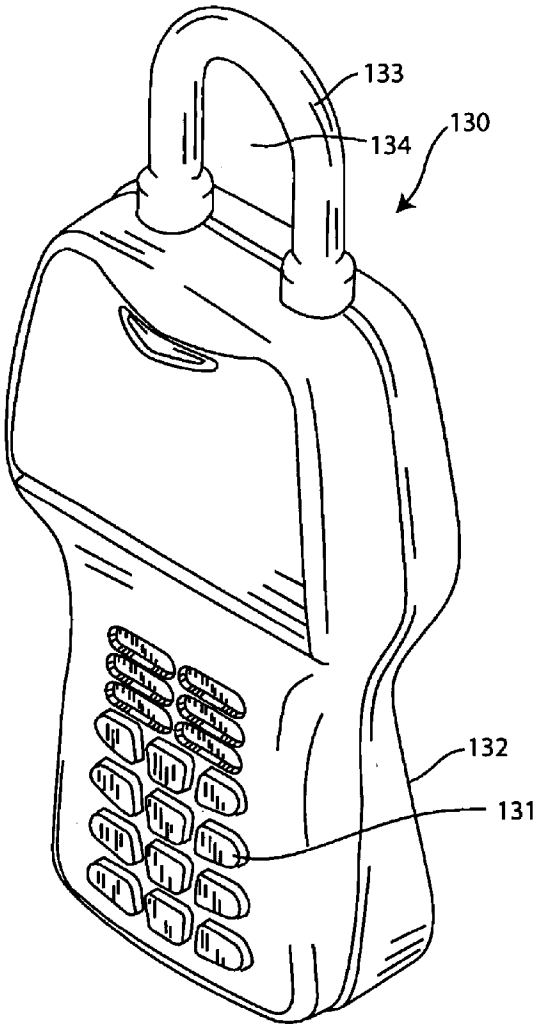
FIG. 3A PRIOR ART
FIG. 3A shows a third exemplary and commonly used lockbox that may be enhanced with suitable embodiments of a lockbox tag system according to the present invention, namely a SentriLock™ lockbox 130 that includes a keypad 131 for accessing the key stored therein using a key code.

The preferred embodiment of FIG. 4 is specifically designed to work with and closely conform to the geometry of the GE Supra iBox™ 110 of FIG. 2A. However, the preferred system 10 can be used with other lockboxes as explained further herein, and other embodiments of the invention may be provided to work with and/or more closely conform to the geometry and/or sizes of the other lockboxes shown in FIGS. 2B, 3A, and 3B, or for any other lockbox, whether electronic or mechanical in nature. In particular, while not shown, the system may be used as is or modified if appropriate to work with a mechanical combination-type lockboxes that are available through retail channels and sometimes used by non-agents in a for-sale by owner situation or by agents in smaller or rural areas.

Figure 5:
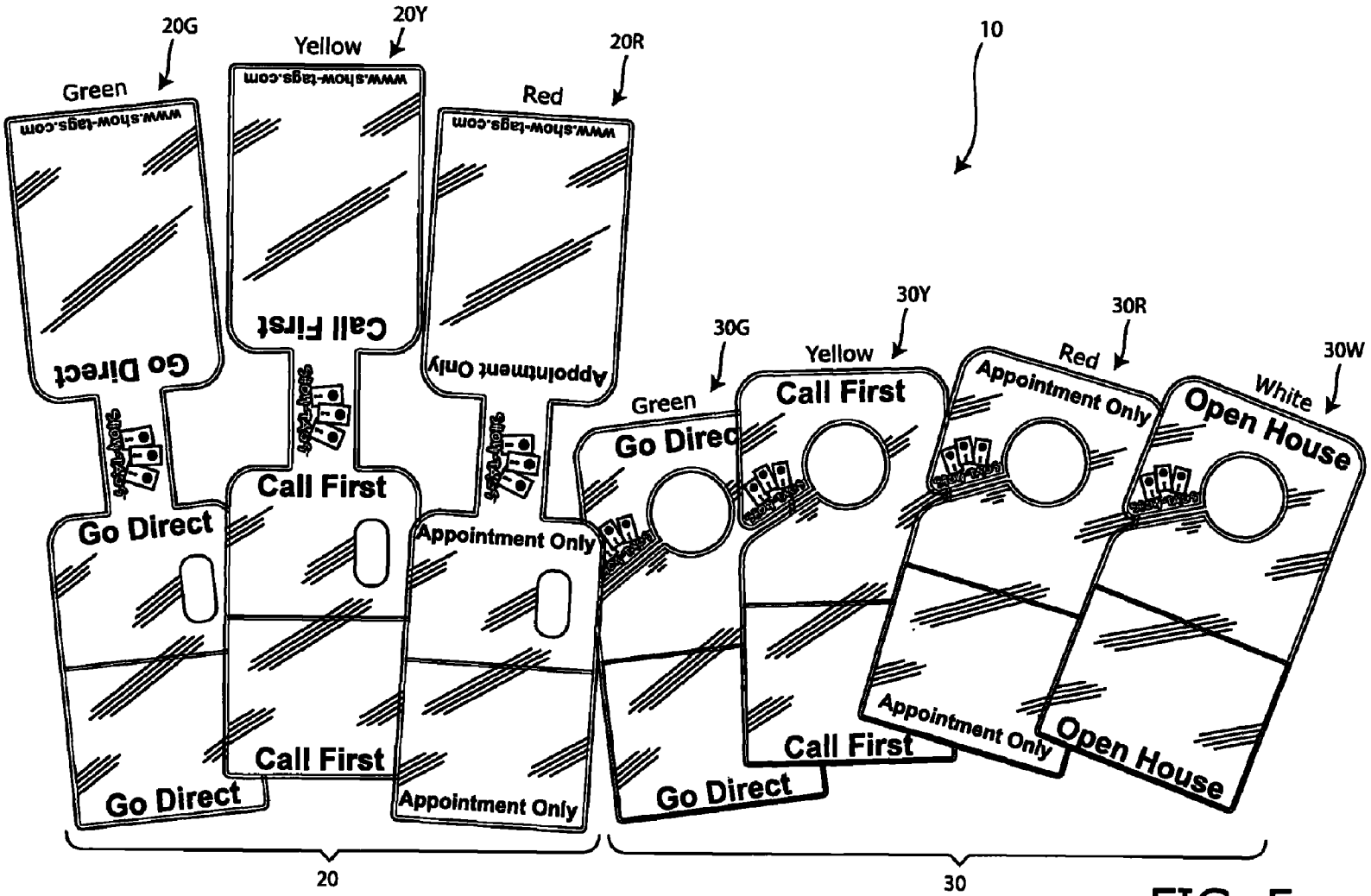
FIG. 5 shows the preferred lockbox tag system 10 of FIG. 4 with the lockbox tags 20 and placards 30 fanned out in one group for comparison and clarity.

As best shown in FIG. 5, the preferred lockbox tag system 10 comprises two sets of items, a set of three lockbox tags 20 that are designed for use with various lockboxes and a set of four optional placards 30 that are designed for use in multiple locations, e.g. on a conventional door, or on the lockbox too, without regard to specific geometry or material. In the intended use, the lockbox tags 20 convey the primary information, and the optional placards 30 supplement that information (e.g. by being hung in additional locations) or override that information (e.g. by being hung on the door adjacent to the primary lockbox tag).

As suggested by the color notations above the preferred lockbox tags 20, the preferred system 10 comprises three color-coded lockbox tags 20G, 20Y, 20R that are green, yellow, and red, and that also bear corresponding indicia to allow real estate agents and/or the home owner to provide "real time" showing instructions without the need to edit MLS data. The tags 20 may also bear branded-related indicia as exemplified by the inventors' own "Show Tags" brand. In the alternative, they might be private labeled to represent a particular realty office, loan company, or escrow company. The preferred system 10 uses green, yellow, and red because those colors mnemonically relate to the colors of a traffic signal where green means go, yellow means caution, and red means stop. In this particular embodiment, the lockbox tags include a green tag 20G that says "Go Direct," a yellow tag 20Y that says "Call First," and a red tag 20R that says "Appointment Only." Of course, alternative and/or additional colors may be used as desired. Also, the indicia may be supplemented and/or varied to correspond with the terms customarily used in different regions or by different associations of real estate agents. For example, white may be used for an additional "Open House" tag (as with the placard 30W described further below), and orange might be used for an additional "In Escrow" tag.

The colors (e.g. green, yellow and red) are intended to communicate the current accessibility status of the property, at a distance, and without need for the showing agent to access the MLS:

Green—Go Direct (no advance notice is required—agent is authorized to enter premises anytime the lockbox is available)

Yellow—Call First/Call Listing Office, agent, or occupant prior to accessing the home. (Agent may call and leave a message prior to showing or receive showing instructions from Listing Agent or Occupant) Yellow cautions the agent to thoroughly review "agent's comments" on the MLS. There may be pets in the home, alarm set, occupants, pending sale, or specific instructions for showing agents.

Red—Appointment Only (Agent must call in advance) Agent should not show or attempt to access the lockbox or property without an appointment.

Figure 6:
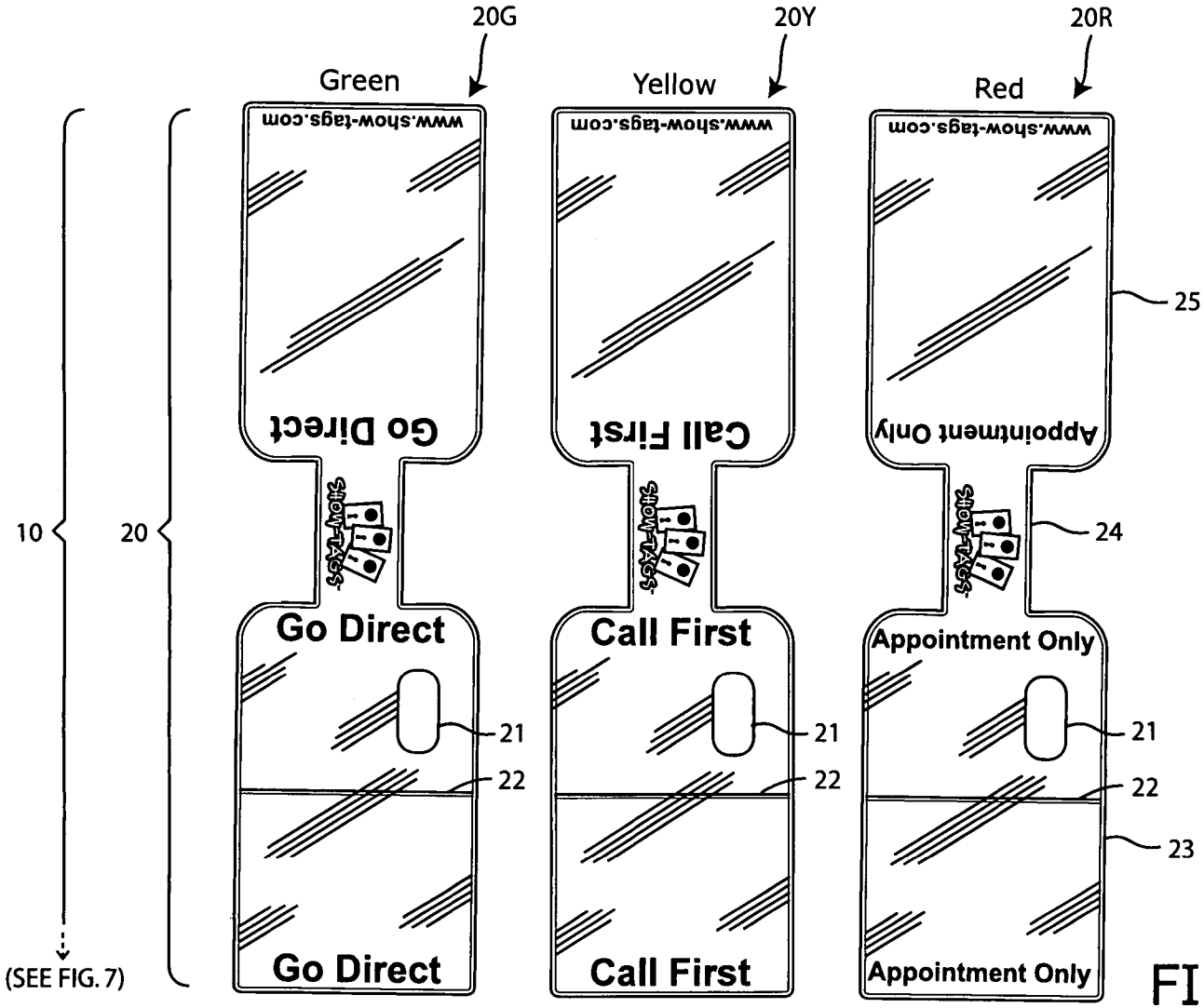
FIGS. 6 and 7 separately and respectively show the lockbox tags 20 and placards 30 of the preferred lockbox tag system 10 of FIG. 4.
Figure 7:
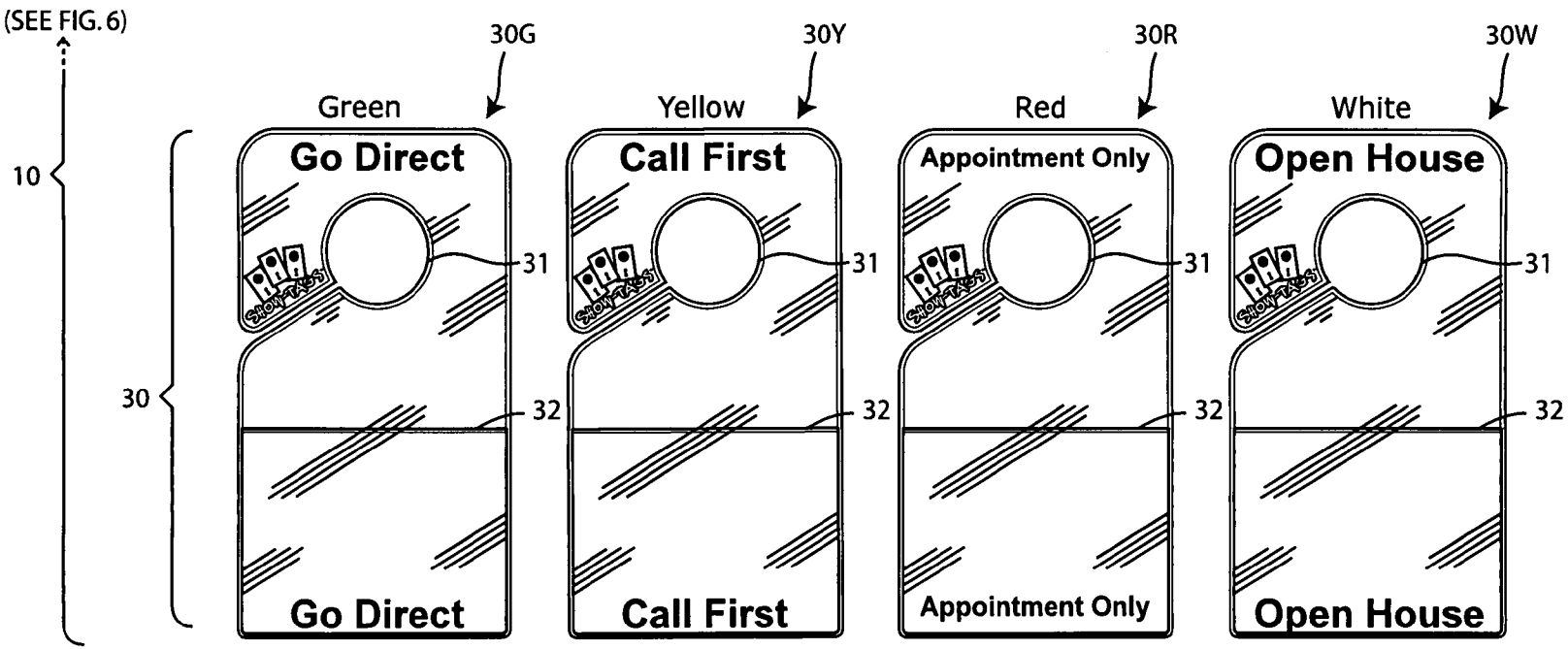

FIGS. 6 and 7 further illustrate the preferred system 10 with the lockbox tags 20 and optional placards 30 displayed separately and without overlap for added clarity As shown in FIG. 6, each lockbox tag 20 comprises a front panel 23, a narrow middle portion 24, and a back panel 25. The particular lockbox tags 20 shown are sized and configured to work best with the lockbox 110 of FIG. 2A, so the exact configuration may vary. As shown with any one of the lockbox tags 20 in FIG. 6, the front panel 23 is substantially flat and sized to cover at least a portion of the front side of the lockbox's main body 112. Similarly, the back panel 25 is substantially flat and sized to cover at least a portion of the back side of the lock box's main body 112.

The preferred lockbox tag 20 and optional placards 30 are made from a flexible and durable material, e.g. die-cut vinyl. In FIG. 6, the lockbox tags 20 appear flat. However, because they are formed from a flexible and durable material such as vinyl, they can be repeatedly attached to and removed from the lockbox 110 (in the case of the lockbox tags 20) or supplemental location (in the case of the optional placards 30).

Figure 8:
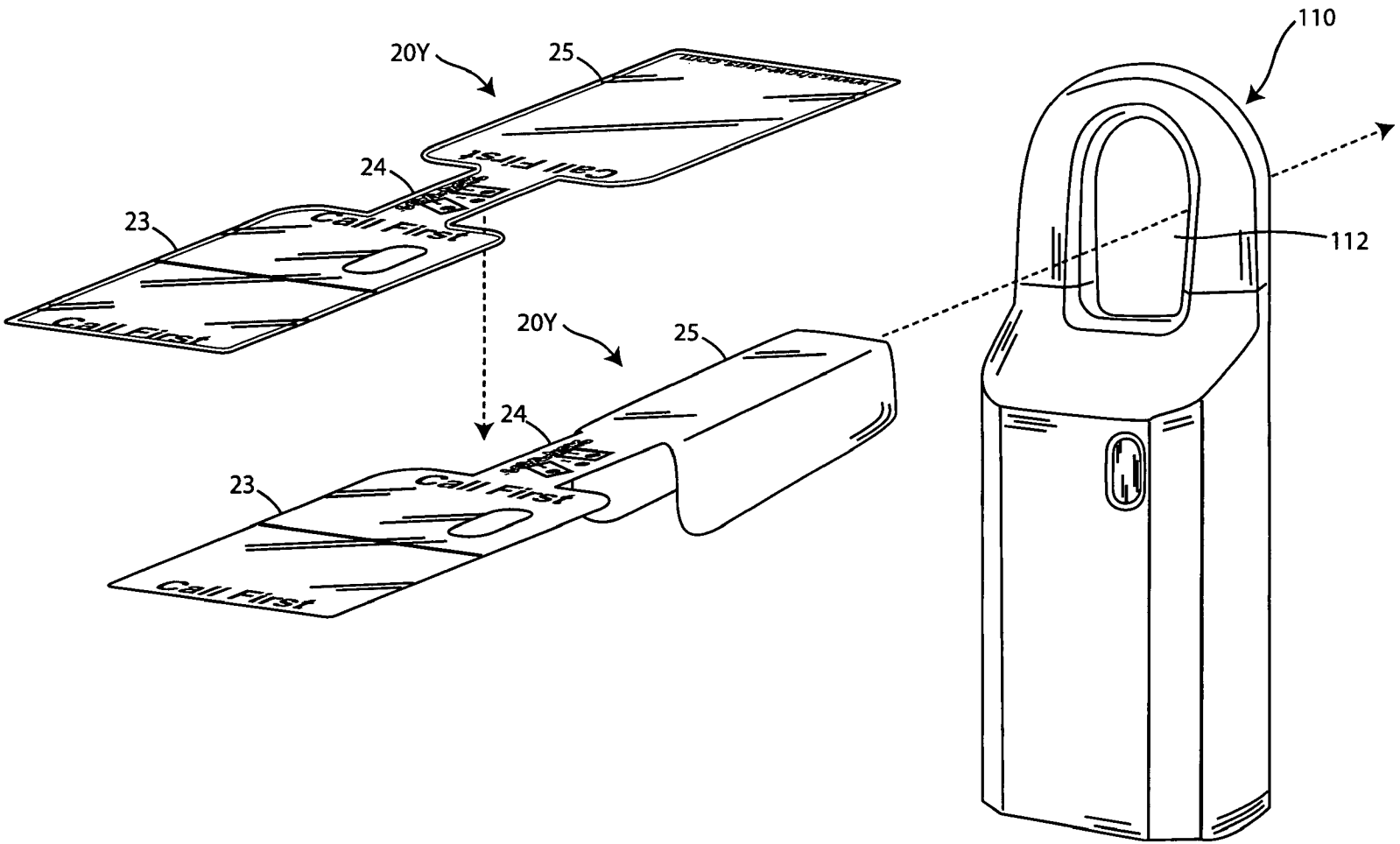
FIG. 8 shows a first preferred lockbox tag 20Y being installed on the first exemplary lockbox 110 (a GE Supra iBox™), the tag's back panel 25 being folded over to fit through the lockbox's shackle aperture 114 and the lockbox tag 20Y being moved forward as suggested by the dashed line until its narrow neck portion 24 is contained within the lockbox's shackle aperture 114.

FIG. 8 shows a first preferred lockbox tag 20Y being installed on the first exemplary lockbox 110 (a GE Supra iBox™). As shown, the tag's back panel 25 is folded over from a flat state to a fold state in order to fit through the lockbox's shackle aperture 114. Then, while the back panel is in the folded state, the lockbox tag 20Y is moved forward as suggested by the horizontally dashed line until its narrow middle portion 24 is located within the lockbox's shackle aperture 114.

Figure 9:
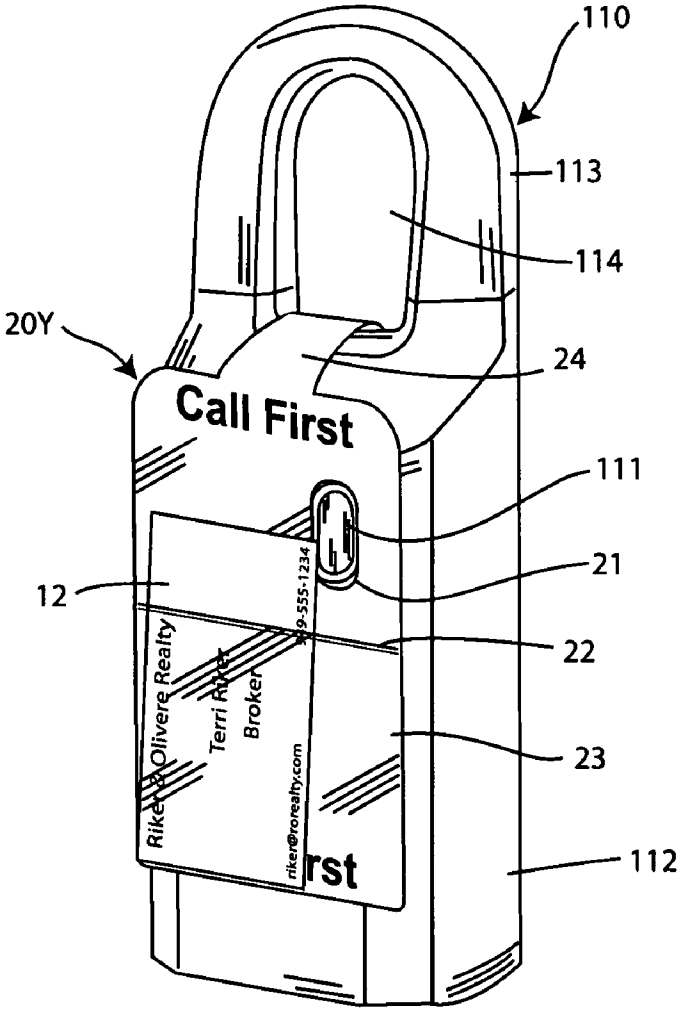
FIG. 9 shows the first preferred lockbox tag 20Y after being fully installed on the first exemplary lockbox 110 (a GE Supra iBox™), the tag's aperture 21 aligned with and exposing the lockbox's infrared port 111 so that the lockbox remains operable. As shown, the tag's clear pocket 22 can hold business cards 12 or other printed material.

FIG. 9 shows the first preferred lockbox tag 20Y after being fully installed on the first exemplary lockbox 110 (a GE Supra iBox™). At this point, the lockbox tag 20 is saddle shaped in that the narrow middle portion 24 is sized to fit within the shackle passage 114 while the front and back panels 23, 25 are in a substantially vertical orientation and are draped down over the front and back sides of the lockbox 110. When installed on the lockbox as shown in FIG. 9, the selected lockbox tag 20G, 20Y or 20R reflects the listing agent's primary showing instructions for the property.

Referring briefly back to FIG. 2A, one sees that the lockbox 110 features an entry mechanism consisting of an infrared port 111 that should not be blocked. The lockbox 120 of FIG. 2B also includes an infrared port 121. As shown in FIG. 9 (and also FIG. 6), the preferred lockbox tags 20 includes an aperture 21 (or clear window) that is sized and positioned to align with and expose the lockbox's infrared port 111 after the tag is installed so that the agent can operate the lockbox without moving the lockbox tag 20. As also shown, the preferred tag's also include a clear pocket 22 that can hold business cards 12 or other printed material.

As also shown in FIG. 5, the primary lockbox tags 20 of the preferred system 10 are augmented by plurality of optional placards 30 that may supplement or even override the primary showing instructions. The desired placard 30 may be placed directly on the lockbox or in another location (i.e. on a door, gate, side entry, sign, or post), using the slotted aperture 31. The presently preferred placard set 30 encompasses, but is not limited to, four colors: Green 30G for "Go Direct," Yellow 30Y for "Call First," Red 30R for "Appointment Only," and White 30W for "Open House." The white color, which is used only on the fourth placard 30W in this embodiment, is intended to communicate the following information:

White—Open House/Caravan/Special Event (Open to the public and/or agents where an access key to the lockbox is not required)

The preferred placards 30, like the lockbox tags 20, comprise at least one pocket 32 to accommodate business cards, post messages, provide additional showing instructions, or indicate the location of the actual lockbox. Additionally, the pocket can be used on either the lockbox tag 20 or optional placard 30 to include details about the home price and features and additional items of interest if unavailable for showing.

The placards 30 can be hung most any where using the slotted aperture 31. As noted earlier, the placards 30 can be used to supplement the lockbox tags 20. For example, in a situation where the lockbox is not attached to the front door (e.g. it is located on a water meter in the side yard and is adorned with a "go direct" lockbox tag 20G), a green "Go Direct" placard 30G can be hung on the front door with instruction on where to locate the lockbox located in its clear pocket 32. The placards 30 can also override the lockbox tags 20. For example, even when the lockbox bears a green "Go Direct" lockbox tag 20G, a tenant can hang a red "Make Appointment" placard 30R if they are home sick.

As noted above, the lockbox tag system 10 may be modified for use with any variety of lockboxes without departing from the spirit or scope or utility of the invention.

Figure 10:
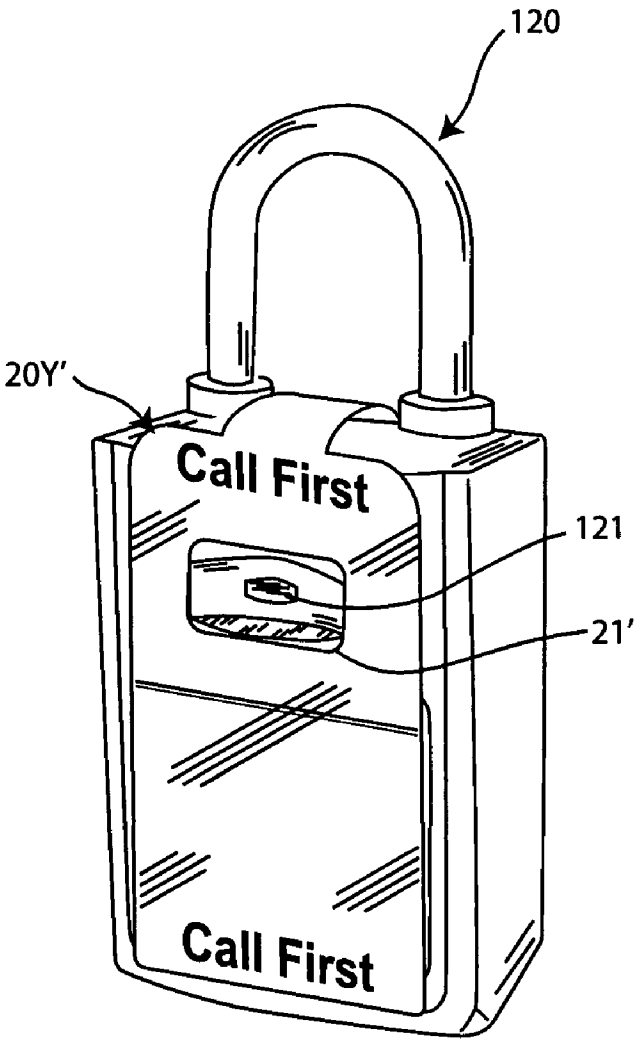
FIG. 10 shows the construction and overall layout of an alternative lockbox tag 20Y' installed on the second exemplary lockbox 120, the lockbox tag 20Y' having a central aperture 21' aligned with and exposing the lockbox's infrared port 121 so that the lockbox remains operable.
Figure 11:
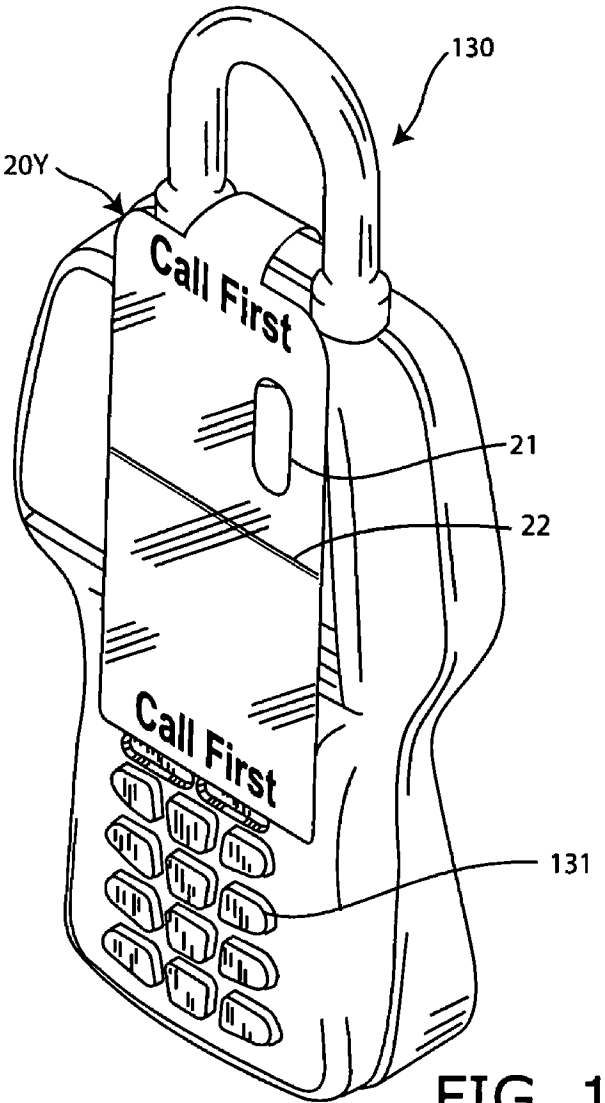
FIG. 11 shows the first preferred lockbox tag 20Y installed on the third exemplary lockbox 130 (a SentriLock™ lockbox 130), the tag's aperture 21 serving no function in this case since the lockbox has a keypad 131 rather than an infrared port.
Figure 12:
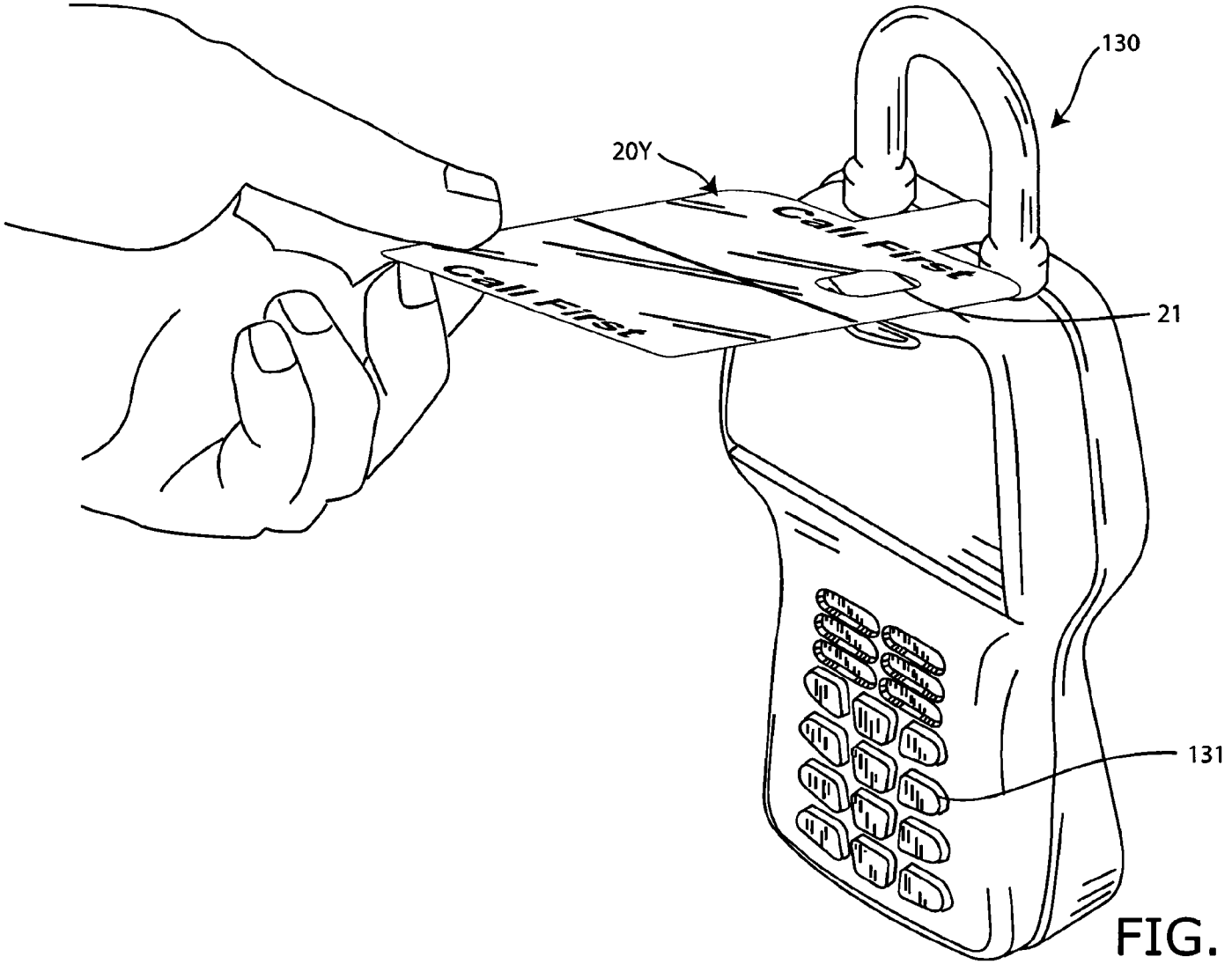
FIG. 12 shows the first preferred lockbox tag 20Y being lifted up and out of the way relative to the position shown in FIG. 11, without being removed, so that the user can access the lockbox's keypad 131.

FIG. 10, for example, shows the construction and overall layout of an alternative lockbox tag 20Y' installed on the second exemplary lockbox 120, the lockbox tag 20Y' having a central aperture 21' (or clear window) aligned with and exposing the lockbox's infrared port 121 so that the lockbox remains operable;

In the embodiments described thus far, the lockbox tags 20 of FIGS. 4-9 and 20Y' of FIG. 10 have been configured for a lockbox 110, 120 having an infrared port 111, 121. However, under various circumstances, it is possible to use one embodiment with various types or sizes of lockboxes. In FIG. 11, for example, a lockbox tag 20Y from the first preferred embodiment (i.e. one having an offset opening 21) is secured to a SentriLock™ lockbox 130 having a keypad 131 that is used to open the lockbox. As shown in FIG. 12, when a real estate agent wishes to access the keypad 131, he or she simply lifts the lockbox tag 20Y as shown, and enters the access code via the keypad 131.

The herein disclosed invention offer many advantages in all of its possible embodiments.

It creates a standard system 10 to inform agents about showing instructions and conveys information about the property.

It eliminates the need for the listing agent to edit the MLS system for brief or last minute changes in showing instructions.

It reduces or eliminates disturbances for the (red) "appointment only" properties that require advance notice.

It provides critical information to protect the privacy of the homeowner and maintain professionalism within the real estate sales industry.

It allows a homeowner, tenant or property manager to change the showing instructions during those times where privacy is required or when unsafe conditions exist. For example, if the agent has set up the property as a (green) "Go Direct" listing for the standard showing instructions, the home owner or tenant who occasionally occupies the property, can temporarily place a (yellow) "Call First" or (red) "appointment only" placard on the lockbox at their discretion.

It takes the burden off the listing agent and allows the occupant of the home to create "real time" showing instructions that fit their lifestyle.

It alleviates some of the inconveniences of living in a home during the time it is "on the market".

It helps a showing agent driving through a neighborhood, allowing them to show additional (green) "Go Direct" listings even if they do not have access to specific listing information and/or showing instructions for that particular property.

It solves the problem associated with Standard MLS reports that do not always include all of the showing details regarding a property. Commonly used 5-line summary reports may exclude "Agent Comments or Remarks", which often contain specific property access/showing information. MLS reports and instructions vary by region; therefore this system may be tailored to replicate the commonly used "showing" terms for each respective area.

It communicates current accessibility information to showing agents who may be working with outdated reports and may be unaware of changes that are included in the MLS.

It allows a real estate agent to quickly canvass a neighborhood and determine which properties on the market are accessible for showings or preview.

The herein disclosed systems is merely a preferred embodiment. In alternative embodiments, the system can be comprised of hanging tags, color wheels, fabric covers, plastic, paper, vinyl signs, rubber bands, paint, coatings, markings, or any color coded system used in conjunction with a lockbox, iBox key box, or other key safe system to indicate the following MLS accepted showing standards:

Green—Go Direct (no advance notice is required—agent is authorized to enter premises anytime the lockbox is available)

Yellow—Call First/Call Listing Office, agent, or occupant prior to accessing the home. (Agent may call and leave a message prior to showing or receive showing instructions from Listing Agent or Occupant) Yellow cautions the agent to thoroughly review "agent's comments" on the MLS. There may be pets in the home, alarm set, occupants, pending sale, or specific instructions for showing agents.

Red—Appointment Only (Agent must call in advance) Agent should not show or attempt to access the lockbox or property without an appointment.

White—Open House/Caravan/Special Event (Open to the public and/or agents where an access key to the lockbox is not required)

We claim:

1. A lockbox tag system comprising:

a lockbox having a main body with an internal key box for storing a key, a front side that carries an access mechanism for opening the key box, a back side, and a hanging shackle defining a shackle passage for securing the main body to a fixed hanging point; and a plurality of different color-coded lockbox tags that attach to the lockbox and visibly communicate a corresponding plurality of desired accessibility states relative to the lockbox using different colors;

wherein each color-coded lockbox tag comprises:

a front panel that is substantially flat and sized to cover at least a portion of the lockbox's main body's front side;

a back panel that is substantially flat and sized to cover at least a portion of the lock box's main body's back side; and a narrow middle portion that is sized to fit within the shackle passage, the middle portion flexibly connecting the front and back panels to one another with the front and back panels in a substantially vertical orientation adjacent to the front and back sides, respectively, of the lockbox.

2. The lockbox tag system of claim 1 wherein the access mechanism comprises an infrared port and further comprising an aperture on the front panel of each color-coded lockbox tag that aligns with and exposes the infrared port when the front panel covers at least a portion of the lock box's main body's front side.

3. The lockbox tag system of claim 2 further comprising a clear pocket attached to the front panel of each color-coded lockbox tag for holding a business card.

4. A lockbox tag system comprising:

a lockbox having a main body with an internal key box for storing a key, a front side that carries an access mechanism for opening the key box, a back side, and a hanging shackle defining a shackle passage for securing the main body to a fixed hanging point; and three differently colored color-coded "I"-shaped lockbox tags that visibly communicate three desired accessibility states relative to the lockbox;

each "I"-shaped lockbox tags comprising a front panel that is substantially flat and sized to cover at least a portion of the lockbox's main body's front side, and a back panel that is substantially flat and sized to cover at least a portion of the lock box's main body's back side, and a narrow middle portion that is sized to fit within the shackle passage, the middle portion flexibly connecting the front and back panels to one another with the front and back panels in a substantially vertical orientation adjacent to the front and back sides, respectively, of the lockbox; and the three color-coded "I"-shaped lockbox tags formed from a flexible material, the back panel foldable between a flat state and a folded state and sized to pass through the shackle passage when in the folded state.

5. The lockbox tag system of claim 4 wherein the three color-coded "I"-shaped lockbox tags are provided in the colors of green, yellow, and red.

6. The lockbox tag system of claim 4 wherein the access mechanism comprises an infrared port and further comprising an aperture on the front panel of each of the three color-coded "I"-shaped lockbox tags, the aperture aligning with and exposing the infrared port when the front panel covers at least a portion of the lock box's main body's front side.

7. The lockbox tag system of claim 4 wherein the back panel of each "I"-shaped lockbox tag is foldable between a flat state and a folded state and sized to pass through the shackle passage when in the folded state.

8. The lockbox tag system of claim 4 wherein each "I"-shaped lockbox tag further comprises indicia on the front panel that visibly communicates a current desired accessibility status relative to the lockbox.

9. The lockbox tag system of claim 8 wherein the indicia is selected from one of "go direct," "call first," and "appointment only".

10. The lockbox tag system of claim 4 wherein each "I"-shaped lockbox tag further comprises a color coded portion on the front panel that visibly communicates a current desired accessibility status relative to the lockbox.

11. The lockbox tag system of claim 10 wherein the color coded portion comprises a color selected from the colors mnemonically related to a traffic signal, namely green, yellow, and red.

* * * * *